US005592697A

United States Patent [19]

Young

[11] Patent Number: 5,592,697

[45] Date of Patent: Jan. 14, 1997

[54] WATERPROOF POCKET

[76] Inventor: Russell Young, Ka On Building, 14th Floor, Apt B2, 65 Catchick Street, Kennedy Town, Hong Kong

[21] Appl. No.: 423,094

[22] Filed: Apr. 18, 1995

[51] Int. Cl.[6] ..... A41D 27/20

[52] U.S. Cl. ..... 2/247; 2/67; 2/250; 206/524.8

[58] Field of Search ..... 2/67, 247, 250, 2/2.15; 206/524.8; 383/61, 63, 64, 907; 150/114

[56] References Cited

U.S. PATENT DOCUMENTS

| | | | |
|---|---|---|---|
| Re. 34,929 | 5/1995 | Kristen | 206/524.8 |
| D. 338,399 | 8/1993 | Conte, Jr. | 206/524.8 X |
| 2,544,840 | 3/1951 | Kowatsch | 2/67 |
| 2,688,914 | 9/1964 | Eckler | 383/907 X |
| 3,980,226 | 9/1976 | Franz | 206/524.8 X |
| 4,928,829 | 5/1990 | Di Bernardo | 206/524.8 |
| 5,165,115 | 11/1992 | Stanislaw | 2/67 X |
| 5,240,112 | 8/1993 | Newburger | 383/63 X |
| 5,255,392 | 10/1993 | Stanislaw | 2/67 X |
| 5,261,532 | 11/1993 | Fauci | 383/63 X |
| 5,421,032 | 6/1995 | Murphy | 2/67 |

*Primary Examiner*—C. D. Crowder
*Assistant Examiner*—Shirra L. Jenkins
*Attorney, Agent, or Firm*—Finnegan, Henderson, Farabow, Garrett & Dunner, L.L.P.

[57] ABSTRACT

A waterproof pocket, for incorporation into, for example, swimming trunks or a wetsuit, having overlying first and second sheets of material defining a pocket. A waterproof closure closes the pocket, and the pocket is provided with an air discharge valve and an air discharge tube connected to a pump, for extracting air from the pocket after it has been closed and sealed in order to prevent air pockets causing inconvenience.

14 Claims, 4 Drawing Sheets

WATERPROOF POCKET

FIELD OF THE INVENTION

This invention relates to a waterproof pocket which may be combined as part of a larger garment such as a wet suit, swimming costume or the like.

BACKGROUND OF THE INVENTION

There are a number of situations in which a reliable waterproof pocket would be desirable. One example is the swimmer visiting the beach. He or she will not wish to leave valuable items such as credit cards and money unattended on the beach while swimming. However, unless there is someone to look after such items this may be unavoidable.

Another example is a diver, either a professional diver or a "social" diver. In addition to valuables, a diver may wish to carry with him or her other items such as papers and maps that should be kept dry.

A waterproof pocket would also be useful in situations where a proposed user does not intend to become completely immersed in water but is likely in any event to become very wet. Persons going salmon fishing, canoeing, sailing or white-water rafting come into this category. Even hikers may appreciate a waterproof pocket in extreme weather conditions.

To date a simple but effective waterproof pocket has yet to appear. Existing pockets are either unreliable or over-complicated in construction.

SUMMARY OF THE INVENTION

According to the present invention there is provided a waterproof pocket comprising: overlying first and second sheets of material sealed together to define a pocket having an opening, a waterproof closure means for closing said opening, a one-way valve for allowing the discharge of air from said pocket after said pocket has been closed by said closure means, and pump means for extracting remaining air from said pocket.

One problem with existing designs is that if air is trapped in the pocket after the pocket is sealed, the presence of that air becomes very inconvenient when a user is in the water since it provides excess buoyancy that will be very inconvenient. The present invention allows removal of this air firstly by means of a one-way air discharge valve, and secondly through a pump means which allows removal of virtually all the air trapped in the pocket.

Preferably the closure means comprises a zip closure having a plurality of interconnecting grooves extending along the length of the opening. The greater the number of grooves the more watertight the closure will be. Preferably, for example, the zip closure comprises four interconnecting grooves. The zip closure is preferably made of high quality nylon and/or plastics so as to be able to withstand repeated use.

The zip closure is closed and opened by means of a runner. Preferably the runner is indented on the sides so as to maximise the sealing of the grooves at the top of the closure and which are more exposed and therefore more vulnerable. In addition the zip closure preferably extends beyond the width of the opening so as to minimise the possibility of water seeping into the pocket through the ends of the closure.

In addition a catch may be attached to the runner so that it may engage the ends of the zip closure when the zip is completely closed so as to lock the runner in place and to prevent it being accidentally moved to open the closure.

Preferably the air discharge valve is located at an end of the pocket remote from the opening. In a particularly preferred arrangement the pocket narrows away from the opening and the air discharge valve is located at the narrow end of the pocket.

The pump means is preferably connected to the interior of the pocket by means of an air discharge tube leading from the interior of the pocket to the pump means. This air discharge tube may enter the pocket at a point adjacent one end of the closure means. Preferably the tube will extend for a distance into the pocket. For example it may be arranged so as to extend along one interior edge of the pocket toward the air discharge valve. The air discharge tube may be provided with a plurality of openings along its length so as to facilitate extraction of air from the pocket at different levels within the pocket.

The pump may comprise any conventional manually operated pump. Preferably, however, the pump is of such a form that it can be easily incorporated into a garment such as a wet suit.

To provide extra protection for the pocket, a flap may be provided that will cover the closure means when the pocket has been closed. This flap may be fixed in place by means of a fastening means such as Velcro (hook and loop fasteners) or the like. Possibly this flap may also include a non-waterproof pocket for items such as keys where it is less important to keep them dry.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
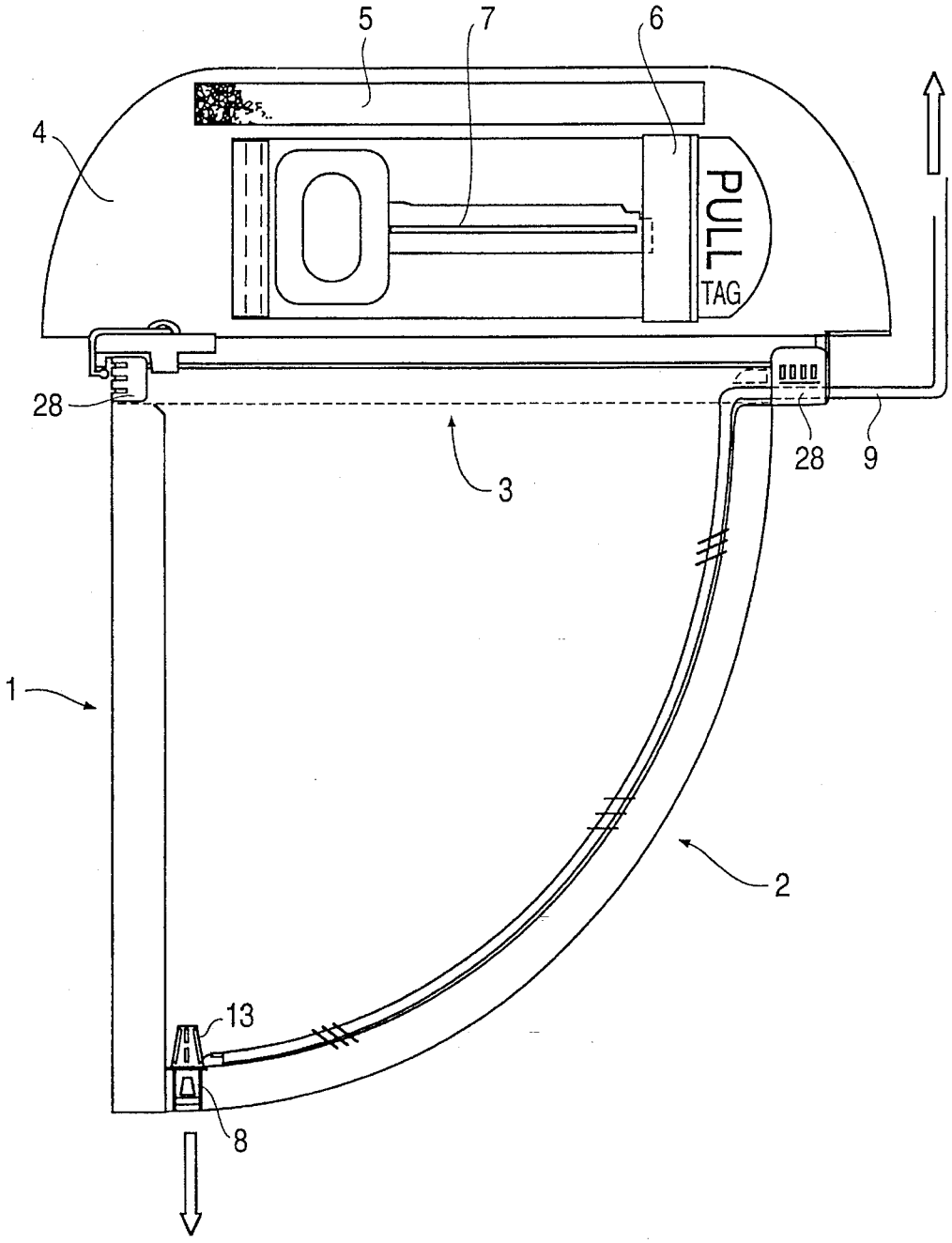
FIG. 1 is a plan view showing a pocket in accordance with the present invention in detail, FIGS. 2(*a*)–(*c*) show the operation of a preferred closure means, FIGS. 3(*a*) & (*b*) show in plan and side views respectively a preferred form of pump.

Referring firstly to FIG. 1 there is shown a first embodiment of the present invention. The pocket comprises two overlying sheets of material, preferably a plastics and/or nylon waterproof material but any material may be used provided that it is waterproof. The pocket is approximately triangular and the two sheets of material are sealed together along a first straight edge 1 and a second arcuate edge 2. A third top edge 3 of the pocket is defined for permitting items to be placed into and removed from the pocket and this top edge is formed with a closure means which will be described in more detail below with reference to FIGS. 2(*a*)–(*c*).

Adjacent the top third edge 3 of the pocket is a flap 4 that may be folded over the top edge 3 and fixed by fastening means such as Velcro (hook and loop fasteners) 5. Formed on the underside of this flap 4 is a supplementary pocket 6. This supplementary pocket 6 is not waterproof and may be used for storing items such as keys 7 which need not be protected from water, and which furthermore may potentially damage and puncture the waterproof pocket if they are kept therein.

At the bottom of the pocket, ie at the junction between the straight edge 1 and the arcuate edge 2 there is provided a one-way air discharge valve 8. By means of this valve 8, when the pocket is closed and sealed, air trapped in the pocket can be expelled through valve 8 by applying pressure to the outside of the pocket. It is important to remove this air since when a user enters water if this air is not removed it will provide undesirable buoyancy. A perforated cap 13 is provided over the valve 8 to prevent it from becoming clogged with fluff or lint or the like.

The air discharge valve 8 may not, however, be sufficient to remove all the air from the pocket. Accordingly therefore a secondary means for removing air is provided. This takes the form of an air discharge tube 9 that is connected to an air extraction pump 10 (see FIGS. 3(*a*) & (*b*) and FIG. 4). Tube 9 enters the pocket at a point adjacent one end of the closure means and extends along the interior of the arcuate second edge 2. The tube 9 is provided with a plurality of openings along its length within the pocket so as to facilitate the extraction of air from any point within the pocket.

Figure 3A:
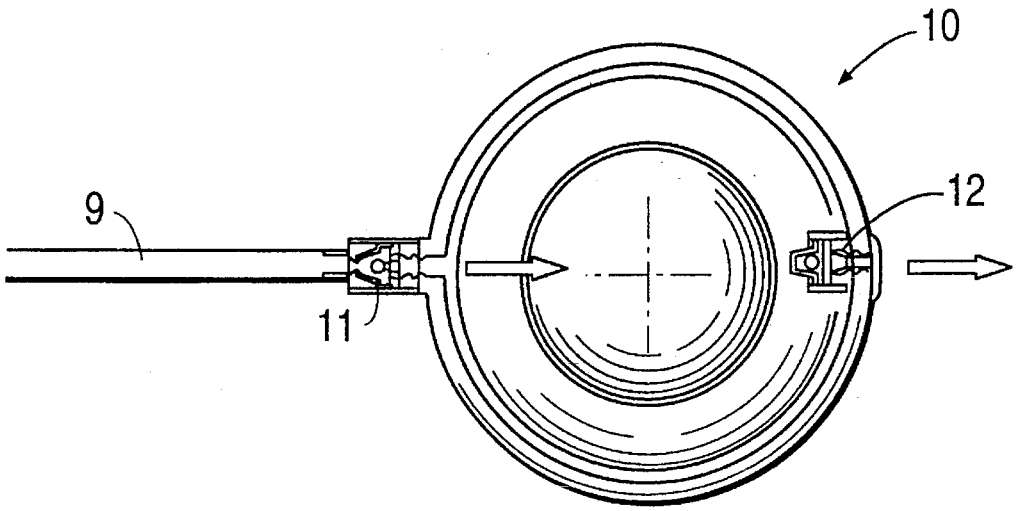
Figure 3B:
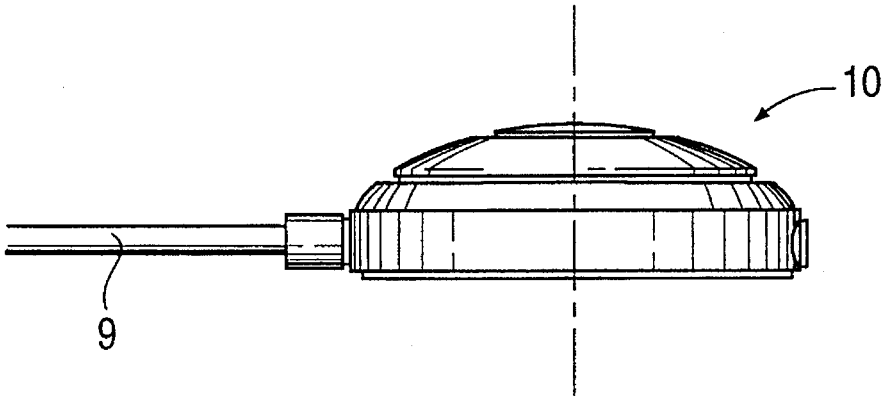

As is seen in FIGS. 3(*a*) & (*b*) the pump 10 is of the conventional type comprising a dome of resilient material such as rubber. The discharge tube 9 is connected to the body of the pump 10 through a one-way valve 11 and air is expelled from the body of the pump 10 through a second one-way valve 12. Operation of the pump 10 is effected by simple pressing down and subsequent release of the resilient dome to draw air into the pump through valve 11 which is then expelled through valve 12 by pressing down on the pump again.

Figure 2A:
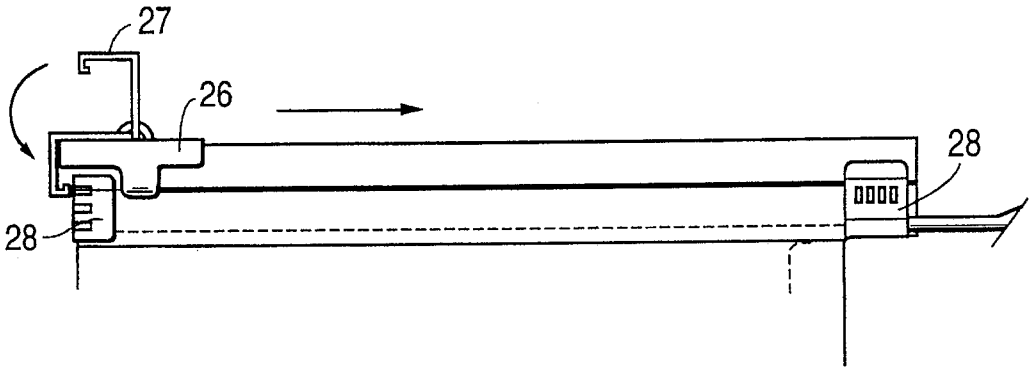
Figure 2B:
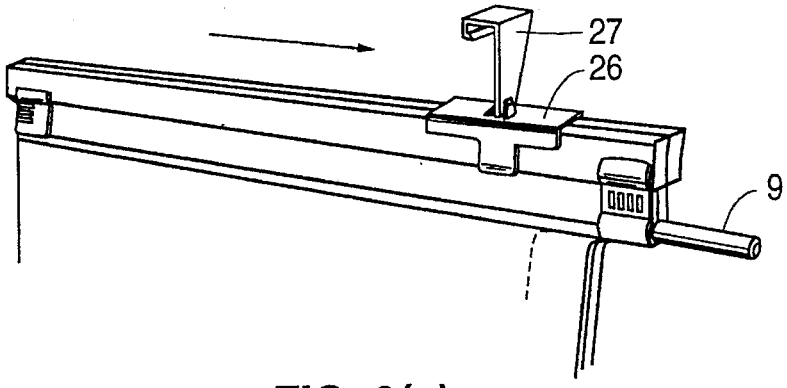
Figure 2C:
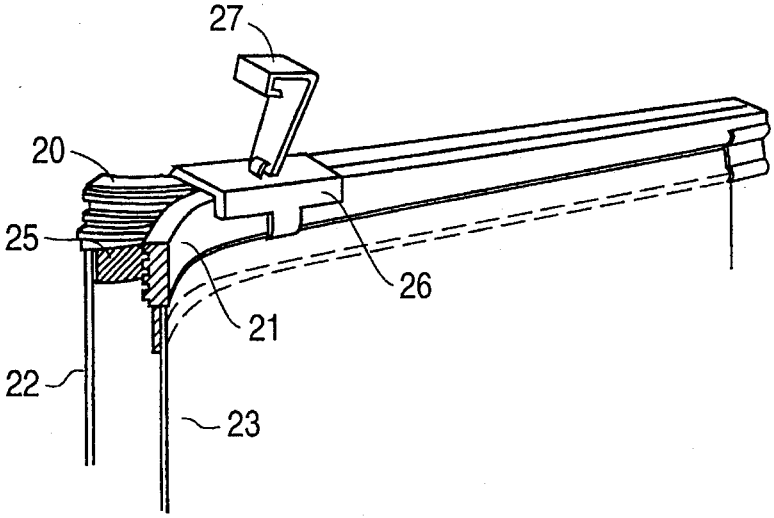

FIGS. 2(*a*)–(*c*) show in more detail the closure means. The flap 4 is not shown for the sake of clarity. The closure means comprises a zip-type closure comprising first and second closure elements 20,21 secured to the respective sheets 22,23 forming the pocket. Each closure element 20,21 is formed with a plurality, for example four, of mutually interconnecting grooves 25 and the closure elements 20,21 are brought into and removed from engagement with each other by means of a runner 26 which is adapted to slide to and fro along the closure means.

The closure means is preferably slightly longer than the top third edge 3 of the pocket. This is to minimise the possibility of water seeping into the pocket through the ends of the closure. In addition the runner 26 is formed with a pivotable catch member 27 which, when the runner is at an extreme end of the closure means and the closure means is in its closed condition, may be fixed over the ends of the closure elements 20,21 to secure the closure in its closed condition and to prevent any accidental movement of the runner 26 to open the closure.

The closure member, and in particular the closure elements 20,21, are formed of a high quality durable plastics or nylon material. Metal end pieces 28 are provided at each end of the closure to provide extra strength and security, and also to provide a stable point of entry for the discharge tube 9 into the pocket.

Figure 4:
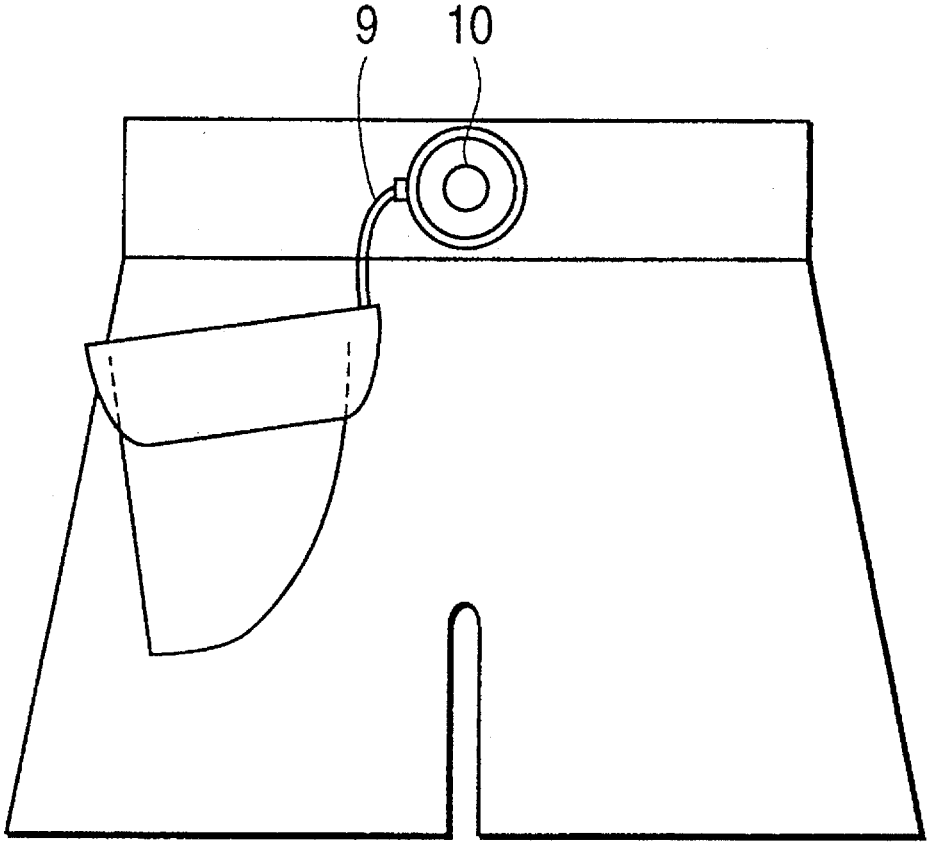
FIG. 4 shows how the pocket may be incorporated into a garment such as a pair of swimming trunks.

FIG. 4 shows, as an example, the pocket of a preferred embodiment formed as a part of a pair of swimming trunks. The pump means 10 may be formed on the waist belt portion of the trunks, and the air discharge tube 9 will be secured to the material of the trunks. If the trunks are made of a suitable material, the lowermost of the two sheets of material could conceivably be formed integrally with the trunks, otherwise the pocket may be secured by any desired method to the trunks.

In use it will be understood that to begin with the items to be stored are placed in the pocket. The closure means is then closed by means of the runner 26 and the catch member 27 is snapped in place over the ends of the closure elements 20,21. Air is then expelled from the pocket through the air discharge valve 8 by simply applying external pressure to the pocket. Remaining air may then be removed by using the pump 10. Finally the flap 4 is folded over the closure.

I claim:

1. A waterproof garment pocket comprising: overlying first and second sheets of a waterproof material sealed together to define a pocket having an opening for receiving an object to be stored in the pocket; a waterproof closure means secured to said pocket for opening and closing said opening; first air extraction means comprising a one-way valve positioned in said pocket and communicating the interior of said pocket with the exterior thereof for allowing discharge of air from said pocket by application of external pressure to said pocket after said pocket has been closed by said closure means; and second air extraction means comprising a pump for extracting remaining air from said pocket, said pump being operatively connected to said pocket and adapted to be formed on said garment.

2. A pocket as claimed in claim 1 wherein said closure means comprises a zip closure having a plurality of interconnecting grooves extending along the length of the opening.

3. A pocket as claimed in claim 1 wherein said closure means extends beyond the width of the opening.

4. A pocket as claimed in claim 1 wherein said closure means includes means for locking said closure means in a closed condition.

5. A pocket as claimed in claim 1 wherein said one-way valve is located at an end of the pocket remote from the opening.

6. A pocket as claimed in claim 5 wherein said pocket narrows away from said opening and said one-way valve is located at a narrowmost end of the pocket.

7. A pocket as claimed in claim 1 wherein the pump is connected to the interior of the pocket by an air discharge tube leading from the interior of the pocket to the pump.

8. A pocket as claimed in claim 7 wherein the air discharge tube enters the pocket at a point adjacent one end of the closure means.

9. A pocket as claimed in claim 7 wherein the air discharge tube extends for a distance within the pocket and is provided with a plurality of openings along its length within the pocket.

10. A pocket as claimed in claim 1 further comprising a flap adapted to cover the closure means.

11. A pocket as claimed in claim 10 wherein said flap includes a second pocket.

12. The pocket as claimed in claim 1, wherein said closure means is provided with reinforcing end pieces.

13. The pocket as claimed in claim 1, wherein said air discharge valve is covered by a perforated cap.

14. The pocket as claimed in claim 1, wherein said closure means comprising a pair of closure elements, each secured to a corresponding one of said sheets adjacent said opening.

* * * * *